US005768742A

United States Patent [19]

Kohl et al.

[11] Patent Number: 5,768,742

[45] Date of Patent: Jun. 23, 1998

[54] MOBILE FLOOR CLEANER

[75] Inventors: Albert Kohl; Thomas Moser, both of Bern, Switzerland

[73] Assignee: Henkel-Ecolab GmbH & Co. OHG, Duesseldorf, Germany

[21] Appl. No.: 793,378

[22] PCT Filed: Aug. 12, 1995

[86] PCT No.: PCT/EP95/03206

§ 371 Date: Mar. 18, 1997

§ 102(e) Date: Mar. 18, 1997

[87] PCT Pub. No.: WO96/05763

PCT Pub. Date: Feb. 29, 1996

[30] Foreign Application Priority Data

Aug. 20, 1994 [DE] Germany ..... 44 29 617.7

[51] Int. Cl.[6] ..... A47L 11/283

[52] U.S. Cl. ..... 15/320; 15/353

[58] Field of Search ..... 15/320, 353

[56] References Cited

U.S. PATENT DOCUMENTS

| | | | |
|---|---|---|---|
| 3,018,504 | 1/1962 | Hart | 15/320 |
| 4,295,244 | 10/1981 | Herpers et al. | 15/320 |
| 4,348,783 | 9/1982 | Swanson et al. | 15/320 |
| 4,464,810 | 8/1984 | Karpanty | 15/320 |
| 4,741,069 | 5/1988 | Helm et al. | 15/320 |
| 4,922,572 | 5/1990 | Kohl et al. | 15/320 |
| 5,535,476 | 7/1996 | Kresse et al. | 15/320 |
| 5,613,270 | 3/1997 | Alvarez et al. | 15/320 |

FOREIGN PATENT DOCUMENTS

| | | | |
|---|---|---|---|
| 0 185 310 | 6/1986 | European Pat. Off. . | |
| 0 224 055 | 6/1987 | European Pat. Off. . | |
| 0 282 850 | 5/1990 | European Pat. Off. . | |
| 0 387 446 | 9/1990 | European Pat. Off. . | |
| 1291068 | 3/1969 | Germany | 15/320 |
| 93 09 461.2 | 9/1993 | Germany . | |
| 94/05196 | 3/1994 | WIPO . | |

*Primary Examiner*—Chris K. Moore

*Attorney, Agent, or Firm*—Ernest G. Szoke; Wayne C. Jaeschke; Kenneth Watov

[57] ABSTRACT

The invention concerns an improvement to a movable floor cleaning machine with integral clean and dirty liquid compartments which are separated from each other by a solid partition with an opening which allows liquid to pass through, and is provided with a closure member which can be opened. By virtue of the improvement, the floor cleaning machine is easy to handle and functions reliably both for recycling cleaning liquids and in normal operation. The closure member which can be opened is a valve body which is resiliently urged from one side of the partition towards the edge of the opening in the closed position. On the other side, and in the region of the opening, the partition is provided with a tubular coupling connection to one end of which a tubular coupling with an associated filter can be coupled. The tubular coupling includes a stop, whereby when the tubular coupling is connected to the tubular coupling connection, the stop urges the valve body into a position opening the closure member for the passage of liquid.

6 Claims, 2 Drawing Sheets

MOBILE FLOOR CLEANER

BACKGROUND

1. Field of the Invention

This invention relates generally to a mobile automatic floor cleaner, and more specifically to such a floor cleaner comprising integrated fresh-liquid and soiled-liquid compartments, a cleaning rotor designed to be supplied from the fresh-liquid compartment and at least one suction nozzle which feeds into the soiled-liquid compartment.

2. Discussion of Related Art

One such mobile automatic floor cleaner is known, for example, from DE 93 09 461 U. In this automatic floor cleaner, cleaning liquid preferably containing a concentrated cleaner is sprayed onto the floor to be treated through the rotor from a separate fresh-liquid compartment. At the same time, the floor is scrubbed by the rotor. A bar-like water suction nozzle which follows the rotor as the cleaner advances sucks up the dirty water still remaining after scrubbing so that the floor can be thoroughly scrubbed and, at the same time, wiped dry, i.e. vacuum-cleaned, to a certain extent in a single operation. This dirty water is returned to the soiled-liquid compartment of the automatic floor cleaner. A pressure equalizing opening and a throughflow opening each provided with an openable closure element are formed in the partition between the soiled-liquid compartment and the fresh-liquid compartment.

By virtue of this construction, the automatic floor cleaner can be operated with recycling of the dirty water, in which case the pressure equalizing opening and the throughflow opening in the partition are opened and dirty water can pass from the soiled-liquid compartment into the fresh-liquid compartment after cleaning to a certain extent by sedimentation and optionally filtration. A satisfactory throughflow of liquid is guaranteed by the pressure equalizing opening because the pressure level in both liquid compartments is the same. On the other hand, the automatic floor cleaner can also be operated in the normal mode with the soiled-liquid compartment and the fresh-liquid compartment separated from one another. In this case, the openings in the partition are closed so that there is no recycling of liquid from the soiled-liquid compartment to the fresh-liquid compartment. In order to close the throughflow opening between the two compartments in the normal mode, the closure element is formed by an elastic ball arranged in the fresh-liquid compartment of which the diameter is larger than the diameter of the associated opening. This ball is drawn sealingly into the corresponding openings in the partition under the effect of the reduced pressure in the soiled-liquid compartment. If, by contrast, the openings are to be uncovered, the balls closing them are moved into the opening position by means of a slide or pivotal lever.

Typically, an automatic floor cleaner of this type can be operated both in the recycling mode, i.e. reusing the soiled liquid as cleaning liquid, and in the normal mode where the soiled liquid is not reused. However, it has been found that the openings in the partition cannot always be reliably closed by the closure balls in the normal mode, for example when there is not enough reduced pressure in the soiled-liquid compartment for example, with the result that soiled liquid can pass from the soiled-liquid compartment into the fresh-liquid compartment, even if this is not intended. This problem can also arise in the recycling mode if solid particles from the soiled liquid settle in and around the throughflow opening and subsequently prevent the balls from fitting tightly therein.

EP 0 224 055 A2 describes an automatic floor cleaner which also comprises a fresh-liquid compartment and a soiled-liquid compartment, the soiled liquid being returned to the soiled-liquid compartment from which it can enter the fresh liquid compartment through an opening in the partition. This opening is designed to be closed by a slide so that the automatic floor cleaner also cannot be used with the opening closed in the recycling mode, i.e. in the normal mode. However, the disadvantage of this automatic floor cleaner is that the opening in the partition is closed by a slide arranged near the base which complicates handling and can easily result in incomplete closure of the opening so that liquid can flow through unintentionally.

SUMMARY OF THE INVENTION

An object of the present invention is to improve an automatic floor cleaner of the type in question in such a way that it would be easy to handle and would operate reliably both in the recycling mode, i.e. reusing the soiled liquid as cleaning liquid, and in the normal mode where the soiled liquid is not reused.

In one embodiment of the invention, an automatic floor cleaner of the type mentioned above includes an openable closure element formed by a valve body pressed by return means from one side of a partition against the rim of an opening in the closing position, the partition being provided on its other side in the vicinity of the opening with a tubular coupling connection to which a tubular coupling with an associated filter at one end, and a stop at its other end, arranged in a throughflow region are respectively designed to be coupled to the tubular coupling connection, for providing the stop in its coupled position pressing the valve body into an open position against the return means.

In another embodiment of the invention, an automatic floor cleaner of the type mentioned at the beginning can be used in the soiled-liquid recycling mode, in which case the tubular coupling is coupled to the coupling connection so that, with its stop against the return means, it keeps the valve body in the open position and soiled liquid can only pass from the soiled-liquid compartment into the fresh-liquid compartment after filtration through the filter in the coupling connection and the filtered liquid being substantially free from solid particles which otherwise may block the throughflow opening. Also, the automatic floor cleaner in another embodiment of the invention can be operated in the normal mode in which the soiled-liquid and fresh-liquid compartments are isolated from one another. In this case, the tubular coupling connection is decoupled so that the valve body is pressed sealingly into the throughflow opening and against the rim thereof by the return means, preventing any exchange of liquid between the two compartments. By virtue of the return means, the closure is immune to other influences, including for example the pressure level in the liquid compartments and incorrect handling by the user.

In a preferred embodiment of the invention, the return means is in the form of a compression spring having a spring force which in relation to the dimensions of the liquid compartments is gauged in such a way that, even if the filling level is at its least favorable level, the pressure applied by the spring to the valve body is greater than any hydrostatic counterpressure on the valve body.

A particularly preferred embodiment of the invention is characterized in that the compression spring is arranged in a flange fixed to the partition in the vicinity of the throughflow opening in the fresh-liquid compartment. In this manner, the compression spring or the valve body can be replaced when necessary.

In another advantageous embodiment, the tubular coupling connection is in the form of a bayonet closure. In this way, it can be safely guaranteed that, given appropriate dimensions of the stop for pressing on the valve body, the valve body is in the open position when the tubular coupling is in place. Basically, however, another type of coupling can also be selected, for example a screw connection or the like.

In another preferred embodiment, the filter is in the form of a filter bag designed to be drawn onto the tubular coupling. This filter can also be readily replaced should it become clogged after repeated use.

Advantageously, a perforated support tube carrying the filter bag is inserted into the tubular coupling. In this way, the filter surface can be enlarged and, at the same time, a stable liquid throughflow zone can be created.

BRIEF DESCRIPTION OF THE DRAWINGS

The invention is described by way of example in the following with reference to the accompanying drawings, in which like itmes have the same reference designation, wherein.

DETAILED DESCRIPTION OF THE INVENTION

Figure 1:
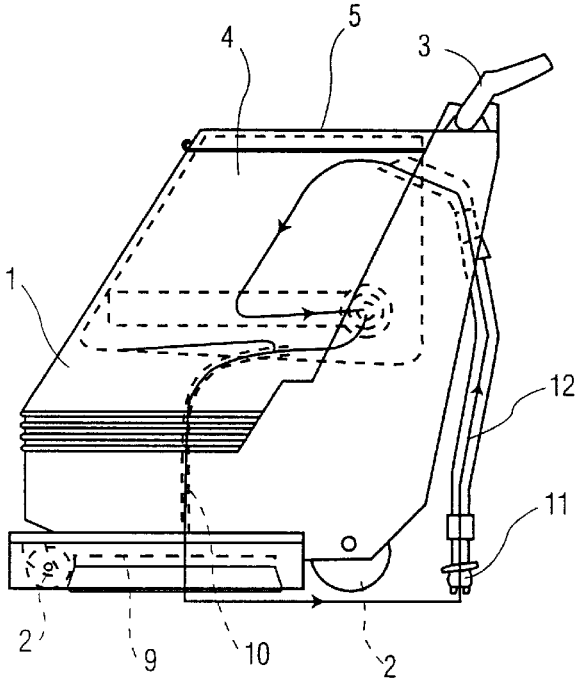
FIG. 1 is a side elevation of a mobile automatic floor cleaner according to the invention.
Figure 2:
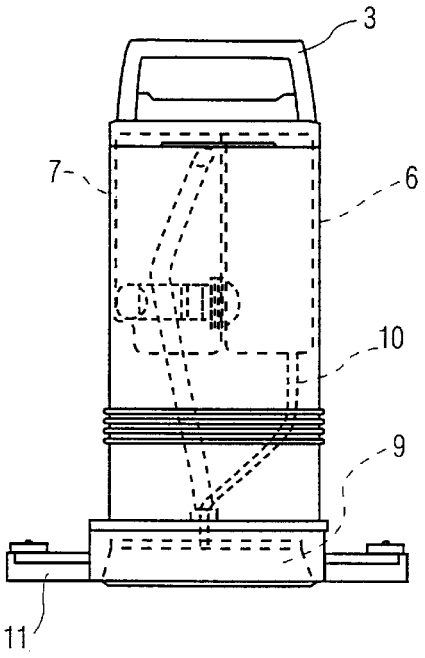
FIG. 2 is a rear view of the automatic floor cleaner shown in FIG. 1.

The mobile automatic floor cleaner shown in FIGS. 1 and 2 comprises a trolley globally denoted by the reference 1 with wheels 2 and a steering handle 3 with an operating mechanism (not shown). A large part of the interior of the trolley 1 accommodates a liquid tank which is globally denoted by the reference 4 and which is designed to be closed by a cover 5.

The liquid tank 4 consists of a fresh-liquid compartment 6 and a soiled-liquid compartment 7, the two compartments 6,7 being separated from one another by a fixed partition 8. Accordingly, the two compartments 6,7 are sealed off in a pressure-tight manner from outside when the cover 5 is in place.

Shown on the bottom of the trolley 1 is a cleaning rotor 9 with brushes which is adapted to be driven by a motor (not shown). The cleaning rotor 9 is connected to the fresh-liquid compartment 6 by a line 10. A suction bar 11 is arranged in the rearward lower part of the trolley, i.e. on that side of the wheels 2 remote from the cleaning rotor 9. Connected to the suction bar 11 is a suction hose 12 which opens through an intake 13 into the soiled-liquid compartment 7 of the liquid tank 4.

Figure 4:
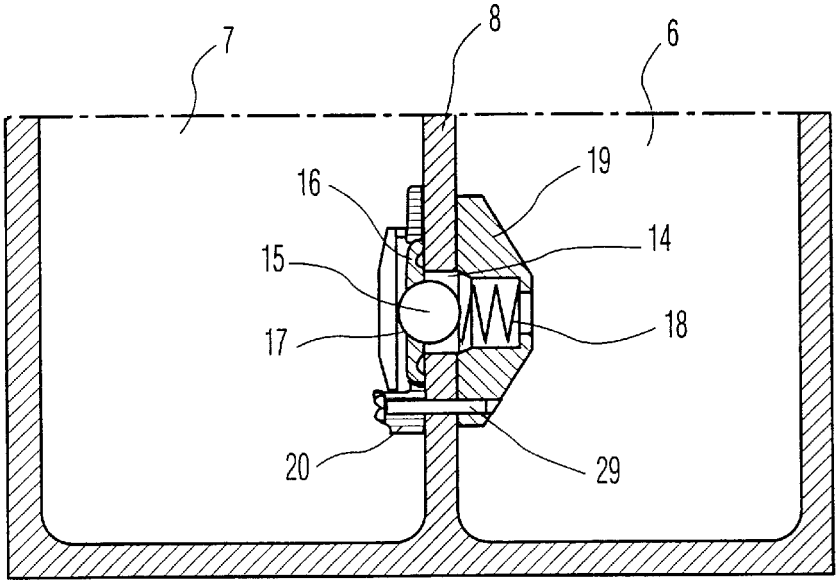
FIG. 4 is a section on a larger scale through part of the liquid tank with fresh-liquid and soiled-liquid compartments in the normal mode.

The construction of the liquid tank 4 is crucial to the invention. Firstly, a throughflow opening 14 is provided in the partition 8 in the lower third thereof between the fresh-liquid and soiled-liquid compartments 6,7. The throughflow opening 14 is designed to be tightly closed by a preferably spherical valve body 15. To guarantee liquid-tight application of the valve body 15, a flange-like insert 16 is preferably fixed to the side of the soiled-liquid compartment 7 in the vicinity of the throughflow opening 14. The flange-like insert 16 slightly extends the throughflow opening 14 into the soiled-liquid compartment 7 beyond the partition 8 and comprises an encircling opening rim 17 adapted to the geometry of the valve body 15 so that, in the closed position (FIG. 4), the valve body 15 bears tightly against the opening rim 17 and thus tightly closes the throughflow opening 14.

In this closed position, the valve body 15 is pressed against the opening rim 17 by a compression spring 18 which is arranged in a flange 19 fixed to the partition 8 in the vicinity of the throughflow opening 14 in the fresh-liquid compartment 6. The dimensions of the compression spring 18 are such that the pressure which it applies to the valve body 15 in the closed position is greater than the maximum hydrostatic counterpressure which can be built up by a difference in level between the two compartments 6,7 so that the valve body 15 is tightly closed in the position shown in FIG. 4.

Figure 3:
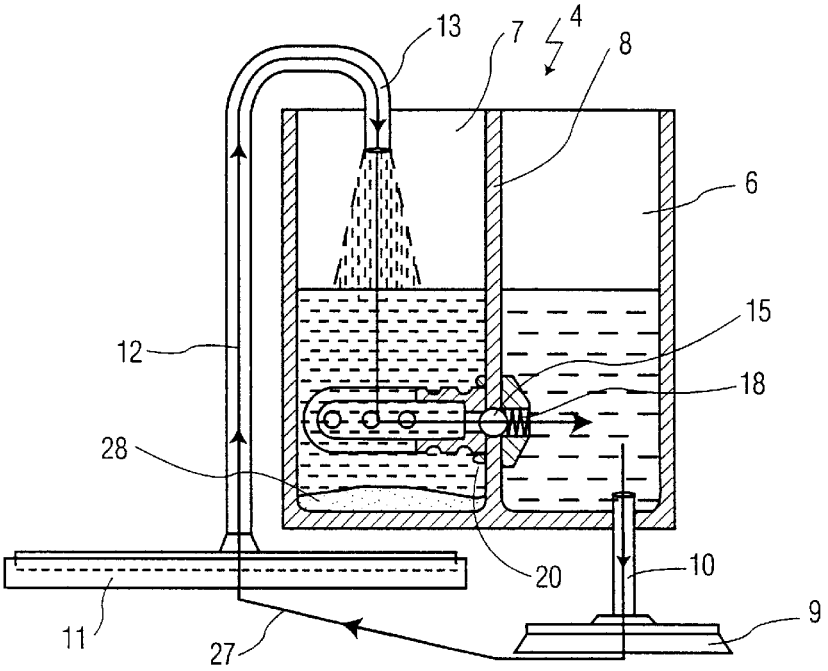
FIG. 3 is a view—partly in section—of a liquid tank of the automatic floor cleaner with fresh-liquid and soiled-liquid compartments and—schematized—a cleaning rotor and suction nozzles in the recycling mode.
Figure 5:
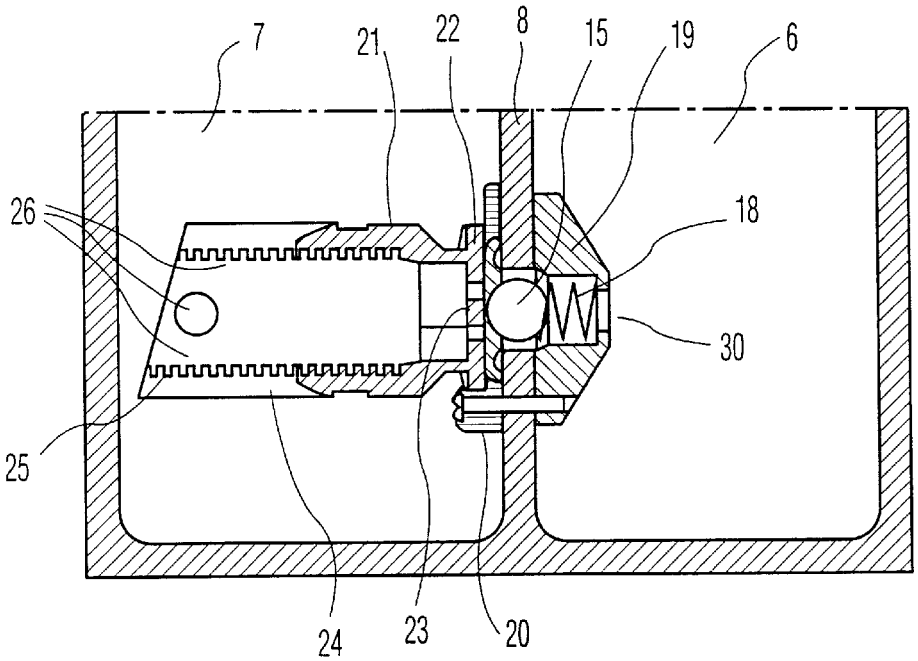
FIG. 5 corresponds to FIG. 4 but shows the liquid tank in the recycling mode.

On its other side, i.e. on the side of the soiled-liquid compartment 7, the partition 8 is provided with a tubular coupling connection 20 in the vicinity of the throughflow opening 14. The tubular coupling connection 20 is preferably fixed to the partition 8 in common with the flange 19 by screws 29 which pass through the partition 8. Any other suitable form of fixing than use of screws can also be utilized. The tubular coupling connection 20 is preferably in the form of a bayonet closure and is intended to receive a tubular coupling 21 which is provided at the end 22 of the coupling with a corresponding bayonet closure so that the tubular coupling 21 can be firmly but releasably coupled at its end 22 to the tubular coupling connection 20. At its end 22, the tubular coupling 21 comprises a stop 23 in the throughflow zone. As shown in FIGS. 3 and 5, the stop 23 in the coupled position of the coupling 21 presses the valve body 15 against the force of the compression spring 18 into the open position so that the throughflow opening 14 is uncovered in places.

A filter bag 24 is fitted or rather drawn onto the other end of the tubular coupling 21. A support hose 25 or rather a support tube provided with perforations 26 is preferably disposed inside the filter bag 24, being inserted into the other end of the coupling 21.

The mode of operation of the automatic floor cleaner according to the invention is preferably as follows below:

When, as shown in FIGS. 3 and 5, the tubular coupling 21 is coupled to the coupling connection 20, the valve body 15 is automatically in its open position so that liquid is able to flow through from the soiled-liquid compartment 7 into the fresh-liquid compartment 6. Fresh liquid is transported from the fresh-liquid compartment 6 through the line 10 into the cleaning rotor 9 and applied to the floor surface to be cleaned. This liquid is taken up again by the suction bar 11 via the flow path 27 and passes through the line 12 and the intake 13 into the soiled-liquid compartment 7 under the effect of the pump-generated reduced pressure prevailing therein. Soil particles produce sediment in the soiled-liquid compartment 7 as, an accumulation of solid particles 28 on the bottom of the soiled-liquid compartment 7 as shown in FIG. 3. Given an appropriate liquid level in the two compartments 6,7, soiled liquid is able to flow through the throughflow opening 14 into the fresh-liquid compartment 6 (flow path 30) substantially free from solid particles after passing through the filter bag 24 and hence after the removal of solid particles 28 and can be reused as cleaning liquid.

If the automatic floor cleaner is to be operated in the normal mode as opposed to the recycling mode, which is advantageous for example when heavily soiled floors are to be cleaned, the liquid tank 4 is opened and the tubular coupling 21 is removed from the coupling connection 20. The effect of this is that the compression spring 18 presses the valve body 15 tightly onto the opening rim 17 of the throughflow opening 14 and thus tightly closes the through-flow opening 14. If, now, the automatic floor cleaner is brought into use, the recycled soiled liquid is unable to pass from the soiled-liquid compartment 7 into the fresh-liquid compartment 6. In this case, after the two compartments 6,7 have been completely emptied and filled, respectively, the fresh-liquid compartment 6 has to be refilled with fresh liquid while the soiled-liquid compartment 7 has to be separately emptied.

The invention is not meant to be confined to the illustrated embodiments. Other modifications are possible without departing from the basic concept. For example, it is of course possible to provide the valve body and the through-flow opening with different shapes and to provide other return means. The filter bag may also assume a different shape and so on. These and other modifications are meant to be covered by the spirit and scope of the appended claims.

We claim:

1. A mobile automatic floor cleaner comprising:

a fresh-liquid compartment;

a soiled-liquid compartment integrated with said fresh-liquid compartment;

a fixed partition separating said fresh-liquid compartment from said soiled-liquid compartment; said partition including a through-flow opening there between;

a cleaning rotor including means for receiving liquid from said fresh-liquid compartment;

a suction nozzle including means for sucking liquid from a floor into said soiled-liquid compartment;

an operable closure element rigidly connected to said through-flow opening of said partition for selectively blocking or opening the throughflow opening, said operable closure element including on a side of said partition opposing and forming a wall of said fresh-liquid compartment, a valve body, and return means for applying a force urging said valve body tightly against a rim of said throughflow opening for closing said throughflow opening to prevent the flow of liquid between said fresh-liquid compartment and said soiled-liquid compartment;

said closure element further including a coupling connector portion on the opposite side of said partition;

a filter; and a tubular coupling including one end portion for receiving said filter, and another end portion opposite said one end portion, the another end portion being configured for removable connecting to said coupling connector, the another end portion including a stop arranged in a liquid throughflow region of said tubular coupling opposing said throughflow opening, whereby whenever said another end portion is connected to said coupling connector, said stop presses against said valve body, forcing it away from said rim of said throughflow opening for placing said closure element in an open position permitting liquid to flow through said through-flow opening of said partition between said soiled-liquid and said fresh-liquid compartments.

2. An automatic floor cleaner as claimed in claim 1 wherein the return means includes a compression spring.

3. An automatic floor cleaner as claimed in claim 1 wherein said return means includes a compression spring arranged in a flange fixed to the partition in the vicinity of the throughflow opening in the fresh-liquid compartment.

4. An automatic floor cleaner as claimed in claim 1 wherein said coupling connector is in the form of a bayonet closure.

5. An automatic floor cleaner as claimed in claim 1 wherein the filter is in the form of a filter bag designed to be drawn onto the tubular coupling.

6. An automatic floor cleaner as claimed in claim 5, further including a perforated support tube carrying the filter bag said support tube being inserted into the tubular coupling.

* * * * *